US010890168B2

(12) United States Patent
Bae et al.

(10) Patent No.: US 10,890,168 B2
(45) Date of Patent: Jan. 12, 2021

(54) LINEAR COMPRESSOR

(71) Applicant: LG ELECTRONICS INC., Seoul (KR)

(72) Inventors: Sanghyun Bae, Seoul (KR); Sunghyun Ki, Seoul (KR); Wonsik Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 453 days.

(21) Appl. No.: 15/811,082

(22) Filed: Nov. 13, 2017

(65) Prior Publication Data

US 2018/0135612 A1 May 17, 2018

(30) Foreign Application Priority Data

Nov. 14, 2016 (KR) ..... 10-2016-0150929

(51) Int. Cl.
*F04B 35/04* (2006.01)
*F04B 39/00* (2006.01)

(52) U.S. Cl.
CPC ..... *F04B 35/04* (2013.01); *F04B 35/045* (2013.01); *F04B 39/0005* (2013.01); *F04B 39/0016* (2013.01); *F04B 39/0055* (2013.01); *F04B 39/0061* (2013.01); *F04B 39/0066* (2013.01);

(Continued)

(58) Field of Classification Search
CPC .... F04B 35/045; F04B 35/04; F04B 39/0016; F04B 39/0005; F04B 39/0027–0038; F04B 39/0055–0072; F04B 39/0083–0088; F04B 53/08; F04B 2201/0804
See application file for complete search history.

(56) References Cited

U.S. PATENT DOCUMENTS 5,677,518 A * 10/1997 Fischer ..... F01N 1/02 181/255
6,398,523 B1 * 6/2002 Hur ..... F04B 35/045 417/312

(Continued)

FOREIGN PATENT DOCUMENTS

KR 10-2003-0083242 10/2003
KR 10-0579578 5/2006
KR 10-2015-0040029 4/2015

OTHER PUBLICATIONS

European Search Report dated Jul. 5, 2018 issued in Application No. 17201262.7.

*Primary Examiner* — Charles G Freay
*Assistant Examiner* — Thomas Fink
(74) *Attorney, Agent, or Firm* — Ked & Associates LLP.

(57) ABSTRACT

A linear compressor is provided. The linear compressor may include a cylinder that defines a compression space, a piston having a plurality of suction holes through which a refrigerant is introduced into the compression space, and a muffler connected to the piston and through which the refrigerant supplied to the piston flows. The muffler may include a seat seated on one side of the piston, and a protrusion arranged inside the piston. The protrusion may include plurality of flow pipes that extends from the seat to an inside of the piston to guide the refrigerant to the plurality of suction holes and a resonator arranged at one side of the plurality of flow pipes and having a resonance space therein.

20 Claims, 10 Drawing Sheets

(52) U.S. Cl.
CPC .. *F04B 39/0088* (2013.01); *F04B 2201/0804* (2013.01)

(56) References Cited

U.S. PATENT DOCUMENTS

| | | | | |
|---|---|---|---|---|
| 2003/0072657 | A1* | 4/2003 | Lee | F04B 35/045 417/417 |
| 2004/0247457 | A1* | 12/2004 | Kim | F04B 35/045 417/312 |
| 2005/0008512 | A1* | 1/2005 | McGill | F04B 35/045 417/416 |
| 2005/0142002 | A1 | 6/2005 | Kang et al. | |
| 2006/0034712 | A1* | 2/2006 | Park | F04B 35/045 417/417 |
| 2006/0060196 | A1* | 3/2006 | Kim | F04B 35/045 128/204.18 |
| 2010/0260629 | A1* | 10/2010 | Kang | F04B 35/045 417/417 |
| 2015/0004014 | A1* | 1/2015 | Kim | F04B 39/0027 417/312 |
| 2015/0004021 | A1* | 1/2015 | Kang | F04B 35/045 417/410.1 |
| 2015/0226210 | A1* | 8/2015 | Barito | F04B 35/045 417/415 |

* cited by examiner

LINEAR COMPRESSOR

CROSS-REFERENCE TO RELATED APPLICATION

This application claims priority under 35 U.S.C. § 119 to Korean Application No. 10-2016-0150929, filed on Nov. 14, 2016, whose entire disclosure is incorporated herein by reference.

BACKGROUND

1. Field

A linear compressor is disclosed herein.

2. Background

A cooling system, which may be a system configured to circulate refrigerant to generate cold air, may repeatedly compress, condense, expand, and evaporate refrigerant. Accordingly, the cooling system may include a compressor, a condenser, an expansion device, and an evaporator. The cooling system may be installed in, for example, home appliances, such as a refrigerator and an air conditioner. The compressor is a machine that receives power from a power generating device such as an electric motor and a turbine to increase pressure by compressing air, refrigerant, or various other working gases, and may be widely used in home appliances or related industries.

Such a compressor may be classified as a reciprocating compressor, in which a compression space into and from which a working gas, such as a refrigerant, is suctioned and discharged may be formed between a piston and a cylinder so that the piston linearly reciprocates inside the cylinder to compress the refrigerant, a rotary compressor, in which a compression space into and from which a working gas, such as a refrigerant, is suctioned and discharged may be formed between an eccentrically rotated roller and a cylinder so that the roller is eccentrically rotated along an inner wall of the cylinder to compress the refrigerant, or a scroll compressor, in which a compression space into and from which a working gas, such as a refrigerant, is suctioned and discharged may be formed between an orbiting scroll and a fixed scroll so that the orbiting scroll is rotated along the fixed scroll to compress the refrigerant.

In reciprocating compressors, a linear compressor may be developed to include a piston directly connected to a reciprocating drive motor so that compression efficiency may be improved without mechanical loss by movement conversion, and this linear compressor may have a simple structure. The linear compressor may be configured to suction, compress, and then discharge a refrigerant while a piston is linearly reciprocated inside a cylinder by a linear motor inside a sealed shell.

The linear motor may be configured such that a permanent magnet may be located between an inner stator and an outer stator, and the permanent magnet may be driven to linearly reciprocate by a mutual electromagnetic force between the permanent magnet and the inner or outer stator. As the permanent magnet is driven while being connected to the piston, refrigerant may be suctioned, compressed, and then discharged while the piston linearly reciprocates inside the cylinder.

Korean Patent No. 10-0579578, whose entire disclosure is incorporated herein by reference, discloses preventing flow loss of a suctioned refrigerant, which may be generated because a suction port eccentrically located on a front surface of a piston and a suction pipe located at a center of a rear surface of the piston may be not located on a straight line. A muffler located outside the piston may be aligned with the suction pipe so that refrigerant may be introduced, and a muffler located inside the piston may be provided as an introduction pipe aligned with the eccentric suction port. Accordingly, refrigerant may move along a short distance from the suction pipe to the suction port so that flow loss may be minimized.

However, because a location of the suction port and a location of the introduction pipe located inside the piston coincide with each other, noise generated in the suction port may move toward an inlet of the muffler through the introduction pipe without diffraction. A vortex may occur at a connector of the muffler located outside the piston and the introduction pipe located inside the piston.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Figure 1:
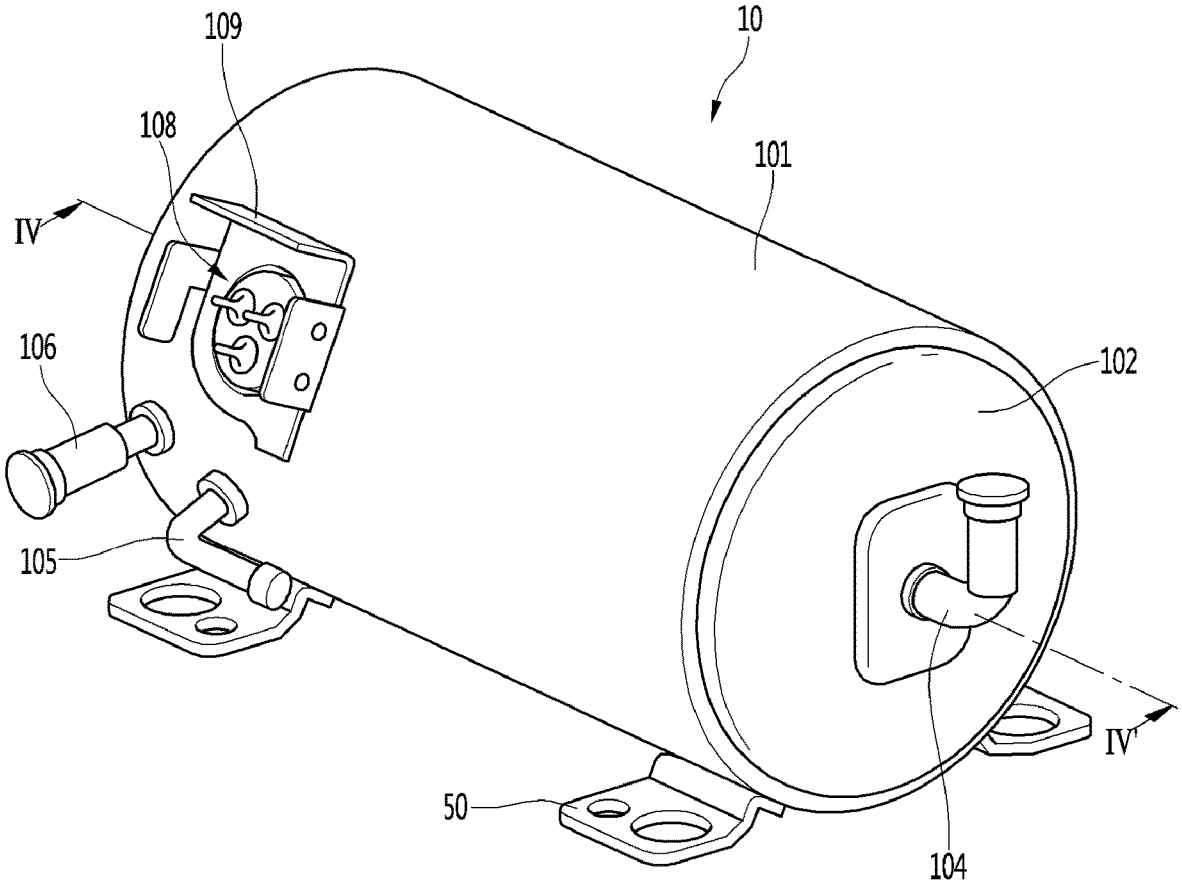
FIG. 1 is a perspective view of an outer appearance of a linear compressor according to an embodiment.
Figure 2:
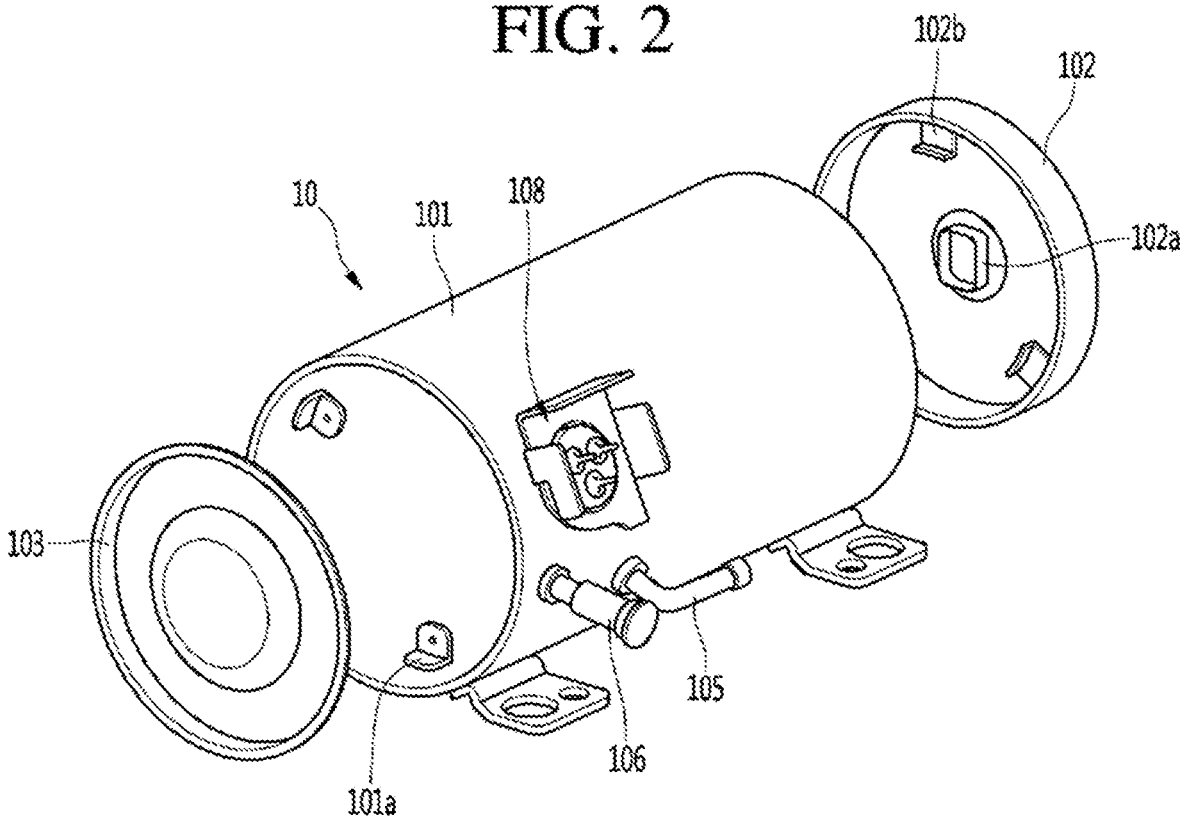
FIG. 2 is an exploded perspective view of a shell and a shell cover of the linear compressor.

Referring to FIG. 1 and FIG. 2, a linear compressor 10 may include a shell 101 and shell covers 102 and 103 coupled to the shell 101. The shell covers 102 and 103 may be understood as one configuration of the shell 101. Legs or base brackets 50 may be coupled to a lower or first portion of the shell 101. The legs 50 may be coupled to a base of a product in which the linear compressor 10 may be installed. For example, the product may be a refrigerator, and the base may be a space in a base of the refrigerator. As another example, the product may be an outdoor unit of an air conditioner, and the base may be a base of the outdoor unit.

The shell 101 may have a cylindrical shape, and may be arranged to be laid transversely or axially. Based on FIG. 1, the shell 101 may extend transversely, and may have a low height in a radial direction. That is, the linear compressor 10 may be low in height so that when the linear compressor 10 is installed in the base or space of the refrigerator, a height of the space may be reduced.

A terminal 108 may be installed on or at an outer surface of the shell 101. The terminal 108 may be configured to transfer external power to a motor assembly 140 (see FIG. 3) of the linear compressor 10. The terminal 108 may be connected to a lead wire of a coil 141*c* (see FIG. 3). A bracket 109 may be installed on an outer side of the terminal 108. The bracket 109 may include a plurality of brackets surrounding the terminal 108. The bracket 109 may function to protect the terminal 108 from an external impact.

Opposite sides or ends of the shell 101 may be open. The shell covers 102 and 103 may be coupled to the open opposite sides of the shell 101. For example, the shell covers 102 and 103 may include a first shell cover 102 coupled to one open or a first side of the shell 101 and a second shell cover 103 coupled to another open or a second side of the shell 101. An inner space of the shell 101 may be sealed or covered by the shell covers 102 and 103.

Referring to FIG. 1, the first shell cover 102 may be located on a right or first side of the linear compressor 10, and the second shell cover 103 may be located on a left or second side of the linear compressor 10. The first and second shell covers 102 and 103 may be arranged to face each other.

The linear compressor 10 may include a plurality of pipes 104, 105, and 106 provided in or at the shell 101 or the shell covers 102 and 103 to suction, discharge, or inject refrigerant. The plurality of pipes 104, 105, and 106 may include a suction pipe 104 through which refrigerant may be suctioned into the linear compressor 10, a discharge pipe 105 through which compressed refrigerant may be discharged from the linear compressor 10, and a process pipe 106 through which the refrigerant may be supplemented or further supplied to the linear compressor 10.

For example, the suction pipe 104 may be coupled to the first shell cover 102. Refrigerant may be suctioned into the linear compressor 10 along an axial direction through the suction pipe 104. The discharge pipe 105 may be coupled to an outer circumferential surface of the shell 101. Refrigerant suctioned through the suction pipe 104 may be compressed while moving in the axial direction. Compressed refrigerant may be discharged through the discharge pipe 105. The discharge pipe 105 may be arranged to be closer to the second shell cover 103 than the first shell cover 102.

The process pipe 106 may be coupled to the outer circumferential surface of the shell 101. A worker may inject refrigerant into the linear compressor 10 through the process pipe 106. The process pipe 106 may be coupled to the shell 101 at a height that is different from a height of the discharge pipe 105, to avoid interference with the discharge pipe 105. The height may be a distance from the leg 50 in a vertical direction or a radial direction. The discharge pipe 105 and the process pipe 106 may be coupled to the outer circumferential surface of the shell 101 at different heights for convenient access and work efficiency.

At least a portion of the second shell cover 103 may be located to be adjacent to an inner circumferential surface of the shell 101, which may correspond to a point where the process pipe 106 may be coupled. In other words, at least a portion of the second shell cover 103 may act as resistance to the refrigerant injected through the process pipe 106.

Thus, in terms of a passage of the refrigerant, a size of the passage of the refrigerant introduced through the process pipe 106 may be decreased toward the inner space of the shell by the second shell cover 103, and increased in turns while passing through the inner space. Because the pressure of the refrigerant is reduced, the refrigerant may be evaporated. Further, oil included in the refrigerant may be separated. Thus, the refrigerant, from which the oil is separated, may be introduced into a piston 130 (see FIG. 3), so that compression performance of the refrigerant may be improved. The oil may be working oil existing in a cooling system.

A cover support 102*a* may be provided on an inner surface of the first shell cover 102. A second support device or support 185 may be coupled to the cover support 102*a*. The cover support 102*a* and the second support device 185 may be configured to support a body of the linear compressor 10. The body of the compressor may be a component provided inside the shell 101, and may include, for example, a drive part or drive that reciprocates in a first or frontward-rearward direction and a support part or support configured to support the drive part. The drive part may include the piston 130, a magnet frame 138, a permanent magnet 146, a supporter 137, and a suction muffler 150, but is not limited thereto. The support part may include resonance springs 176*a* and 176*b*, a rear cover 170, a stator cover 149, a first support device or support 165, and the second support device or support 185, but is not limited thereto.

A stopper 102*b* may be provided on an inner surface of the first shell cover 102. The stopper 102*b* may be configured to prevent the body of the linear compressor 10 and the motor assembly 140 from being damaged by collision with the shell 101 due to vibration or impact generated during transportation of the linear compressor 10. The stopper 102*b* may be adjacent to the rear cover 170, and when the linear compressor 10 shakes, the rear cover 170 may interfere or interact with the stopper 102 so that an impact may be prevented from being transferred to the motor assembly 140.

Spring fastened parts or fasteners 101*a* may be provided on an inner circumferential surface of the shell 101. For example, the spring fastened parts 101*a* may be arranged to be adjacent to the second shell cover 103. The spring fastened parts 101*a* may be coupled to a first support spring 166 of the first support device 165. As the spring fastened parts 101*a* and the first support device 165 are coupled to each other, the body of the linear compressor 10 may be stably supported on an inner side of the shell 101.

Figure 3:
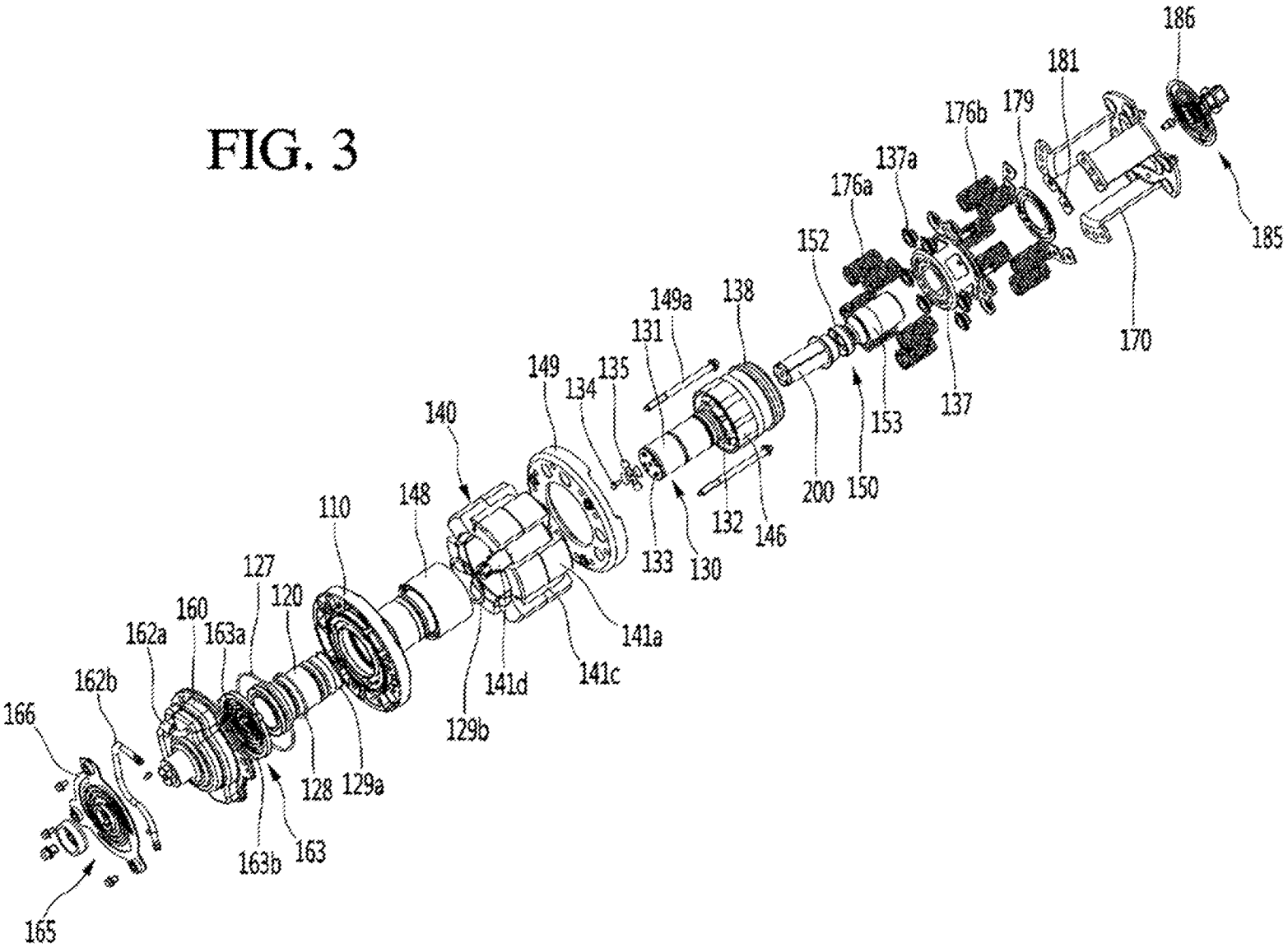
FIG. 3 is an exploded perspective view of components of the linear compressor.
Figure 4:
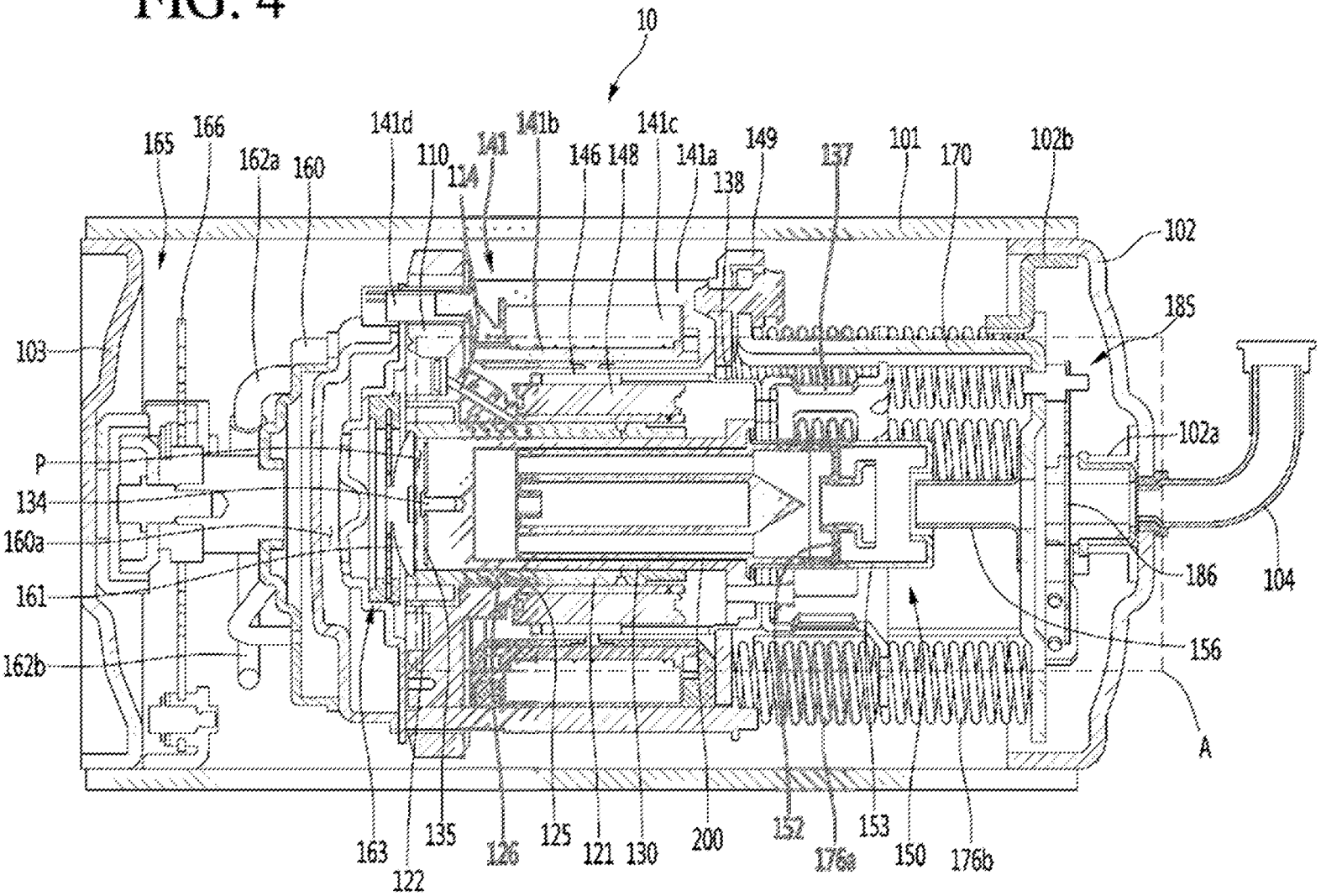
FIG. 4 is a sectional view of components of the linear compressor taken along line IV-IV' of FIG. 1.

Referring to FIG. 3 and FIG. 4, the linear compressor 10 may include a cylinder 120 provided inside the shell 101, the piston 130 that linearly reciprocates inside the cylinder 120, and the motor assembly 140 as a linear motor configured to provide a driving force to the piston 130. When the motor assembly 140 is driven, the piston 130 may reciprocate in an axial direction.

The linear compressor 10 may include the suction muffler 150 connected to the piston 130 and configured to reduce noise generated by the refrigerant suctioned through the suction pipe 104. The refrigerant suctioned through the suction pipe 104 may flow to an inside of the piston 130 via the suction muffler 150. While the refrigerant passes through the suction muffler 150, flow noise of the refrigerant may be reduced.

The suction muffler 150 may include a plurality of mufflers 200, 152, and 153. The plurality of mufflers 200, 152, and 153 may include a first muffler 200, a second muffler 152, and a third muffler 153. The first muffler 200 may be located inside the piston 130, and the second muffler 152 may be coupled to a rear side of the first muffler 200. The third muffler 153 may accommodate the second muffler 152 therein, and may extend to a rear side of the first muffler 200. In terms of a flow direction of the refrigerant, the refrigerant suctioned through the suction pipe 104 may sequentially pass through the third muffler 153, the second muffler 152, and the first muffler 200, and the flow noise of the refrigerant may be reduced.

A muffler filter may be located on or at a boundary surface, on or at which the first muffler 200 and the second muffler 152 are coupled to each other. The muffler filter may have a circular shape, and an outer circumference of the muffler filter may be supported between the first and second mufflers 200 and 152.

An "axial direction" may be a direction in which the piston 130 reciprocates, that is, a vertical direction in FIG. 4. In the "axial direction", a direction from the suction pipe 104 to a compression space P, that is, a direction in which the refrigerant flows, may be a "frontward direction", and a direction that is opposite thereto may be a "rearward direction". For example, when the piston 130 is moved in the frontward direction, the compression space P may be compressed. A "radial direction" may be a direction that is perpendicular to the direction in which the piston 130 reciprocates, that is, a transverse direction in FIG. 4.

The piston 130 may include an approximately cylindrical piston body 131 and a piston flange 132 that extends from the piston body 131 in the radial direction. The piston body 131 may reciprocate inside the cylinder 120, and the piston flange 132 may reciprocate outside the cylinder 120. The cylinder 120 may accommodate at least a portion of the first muffler 200 and at least a portion of the piston body 131.

The compression space P in which the refrigerant may be compressed by the piston 130 may be formed inside the cylinder 120. Suction holes 133 through which the refrigerant may be introduced into the compression space P may be formed on a front surface of the piston body 131, and a suction valve 135 configured to selectively open the suction holes 133 may be provided on or at a first or front side of the suction holes 133. A fastening hole 135*a* (see FIG. 6) to which a predetermined fastener 134 may be coupled may be formed on an approximately central portion of the suction valve 135.

The linear compressor 10 may include a discharge cover 160 and discharge valve assemblies 161 and 163. The discharge cover 160 may be installed on or at a first or front side of the compression space P and may define a discharge space 160*a* for the refrigerant discharged from the compression space P. The discharge space 160*a* may include a plurality of spaces partitioned by an inner wall of the discharge cover 160. The plurality of spaces may be arranged in the first or front-rear direction, and may communicate or connect with each other.

The discharge valve assemblies 161 and 163 may be coupled to the discharge cover 160 and may selectively discharge the refrigerant compressed in the compression space P. The discharge valve assemblies 161 and 163 may include a discharge valve 161 which, when the pressure of the compression space P is not less than a discharge pressure, may open to introduce the refrigerant into the discharge space 160*a*, and a spring assembly 163 provided between the discharge valve 161 and the discharge cover 160 to provide an elastic force in the axial direction.

The spring assembly 163 may include a valve spring 163*a* and a spring support 163*b* configured to support the valve spring 163*a* on the discharge cover 160. The valve spring 163*a* may include a leaf spring. The spring support 163*b* may be injection-molded integrally with the valve spring 153*a* via an injection molding process, for example.

The discharge valve 161 may be coupled to the valve spring 163*a*, and a rear side or a rear surface of the discharge valve 161 may be located to be supported on a front surface of the cylinder 120. When the discharge valve 161 is supported on the front surface of the cylinder 120, the compression space P may be sealed, and when the discharge valve 161 is spaced apart from the front surface of the cylinder 120, the compression space P may be opened, so that the compressed refrigerant inside the compression space P may be discharged.

That is, the compression space P may be a space formed between the suction valve 135 and the discharge valve 161. The suction valve 135 may be formed on or at one or a first side of the compression space P, and the discharge valve 161 may be provided on or at the other or a second side of the compression space P, that is, on a side opposite to the suction valve 135.

While the piston 130 linearly reciprocates inside the cylinder 120, when the pressure of the compression space P is not more than a suction pressure, the suction valve 135 may be opened so that the refrigerant may be suctioned into the compression space P. When the pressure of the compression space P is not less than the suction pressure, in a state in which the suction valve 135 is closed, the refrigerant of the compression space P may be compressed.

When the pressure of the compression space P is not less than the discharge pressure, the valve spring 163*a* may be deformed to a first or front side to open the discharge valve 161, and the refrigerant may be discharged from the compression space P to the discharge space 160*a* of the discharge cover 160. When the refrigerant is completely discharged, the valve spring 163*a* may provide a restoring force to the discharge valve 161, so that the discharge valve 161 may be closed.

A cover pipe 162*a* may be coupled to the discharge cover 160 such that the refrigerant flowing in the discharge space 160*a* of the discharge cover 160 may be discharged. The cover pipe 162*a* may be made of metal, for example. A loop pipe 162*b* may be further coupled to the cover pipe 162*a* such that the refrigerant flowing through the cover pipe 162*a* may be transferred to the discharge pipe 105. One side of the loop pipe 162*b* may be coupled to the cover pipe 162*a*, and another side of the loop pipe 162*b* may be coupled to the discharge pipe 105.

The loop pipe 162*b* may be made of a flexible material and may extend from the cover pipe 162*a* along an inner circumferential surface of the shell 101 and may be coupled to the discharge pipe 105. The loop pipe 162*b* may have a shape that is wound and may be rounded or curved.

The linear compressor 10 may further include a frame 110. The frame 110 may be configured to fix the cylinder 120. The cylinder 120 may be, for example, press-fitted to an inside of the frame 110. The cylinder 120 and the frame 110 may be made of aluminum or aluminum alloy, for example. The frame 110 may surround the cylinder 120. That is, the cylinder 120 may be accommodated inside the frame 110. The discharge cover 160 may be coupled to a front surface of the frame 110 by a fastener, for example.

The motor assembly 140 may include an outer stator 141 fixed to the frame 110 and arranged to surround the cylinder 120, an inner stator 148 spaced apart from an inner side of the outer stator 141, and the permanent magnet 146 located in a space between the outer stator 141 and the inner stator 148. The permanent magnet 146 may linearly reciprocate due to an electromagnetic force of or from the outer stator 141 and the inner stator 148. The permanent magnet 146 may be configured as a single magnet having one pole or a plurality of magnets having three poles.

The permanent magnet 146 may be installed in the magnet frame 138. The magnet frame 138 may have a cylindrical shape, and may be inserted into a space between the outer stator 141 and the inner stator 148. Referring to FIG. 4, the magnet frame 138 may be coupled to the piston flange 132 to extend in an outward radial direction and to be bent in a frontwards direction. The permanent magnet 146 may be installed on or at a first or front side of the magnet frame 138. Accordingly, when the permanent magnet 146 reciprocates, the piston 130 may reciprocate in the axial direction together with the permanent magnet 146.

The outer stator 141 may include coil wound bodies 141*b*, 141*c*, and 141*d*, and a stator core 141*a*. The coil wound bodies 141*b*, 141*c*, and 141*d* may include a bobbin 141*b* and a coil 141*c* wound in a circumferential direction of the bobbin 141*b*. The coil wound bodies 141*b*, 141*c*, and 141*d* may further include a terminal 141*d* configured to guide a power line connected to the coil 141*c* such that the power line may be withdrawn or exposed to the outside of the outer stator 141. The terminal 141*d* may be arranged to be inserted into a terminal insertion part provided in the frame 110.

The stator core 141*a* may include a plurality of core blocks configured or formed by stacking a plurality of laminations in a circumferential direction. The plurality of core blocks may be arranged to surround at least a portion of the coil wound bodies 141*b* and 141*c*.

A stator cover 149 may be provided on or at one or a first side of the outer stator 141. That is, one or the first side of the outer stator 141 may be supported by the frame 110, and another or a second side of the outer stator 141 may be supported by the stator cover 149. The stator cover 149 and the frame 110 may be fastened to each other through a cover fastener 149*a*, for example. The cover fastener 149*a* may pass through the stator cover 149 to extend toward the frame 110 in the frontwards direction, and may be coupled to a fastening hole provided in the frame 110. The inner stator 148 may be fixed to an outer circumference of the frame 110. The inner stator 148 may be configured or formed by stacking a plurality of laminations on an outer side of the frame 110 in the circumferential direction, for example.

The linear compressor 10 may include the supporter 137 configured to support the piston 130. The supporter 137 may be coupled to a rear side of the piston 130, and the suction muffler 150 may be arranged inside the supporter 137 to pass through the supporter 137. The piston flange 132, the magnet frame 138, and the supporter 137 may be fastened to each other via a fastener, for example. A balance weight 179 may be coupled to the supporter 137. A weight of the balance weight 179 may be determined based on a range of operating frequencies of the body of the linear compressor 10.

The linear compressor 10 may include the rear cover 170 coupled to the stator cover 149 to extend rearward and may be supported by the second support device 185. The rear cover 170 may include three support legs, and the three support legs may be coupled to a rear surface of the stator cover 149. A spacer 181 may be interposed between the three support legs and the stator cover 149. A distance between the stator cover 149 and a rear end of the rear cover 170 may be determined by adjusting a thickness of the spacer 181. The rear cover 170 may be spring-supported on the supporter 137.

The linear compressor 10 may include an inlet guide 156 coupled to the rear cover 170 to guide inflow of the refrigerant to the suction muffler 150. At least a portion of the inlet guide 156 may be inserted into the suction muffler 150.

The linear compressor 10 may include the plurality of resonance springs 176*a* and 176*b*, natural frequencies of which may be adjusted such that the piston 130 may resonate. The plurality of resonance springs 176*a* and 176*b* may include a first resonance spring 176*a* supported between the supporter 137 and the stator cover 149, and a second resonance spring 176*b* supported between the supporter 137 and the rear cover 170. Stable movement of the drive part reciprocating inside the linear compressor 10 may be performed by the action of the plurality of resonance springs 176*a* and 176*b*, and an amount of vibration or noise generated due to the movement of the drive part may be reduced. The supporter 137 may include a first spring support 137*a* coupled to the first resonance spring 176*a*.

The linear compressor 10 may include the frame 110 and a plurality of sealing members 127, 128, 129*a*, and 129*b* that increases coupling forces between components near the frame 110. For example, the plurality of sealing members 127, 128, 129*a*, and 129*b* may include a first sealing member 127 provided at a portion where the frame 110 and the discharge cover 160 are coupled to each other. The first sealing member 127 may be arranged at or in a first installation groove of the frame 110.

The plurality of sealing members 128, 128, 129*a*, and 129*b* may include a second sealing member 128 provided at a portion where the frame 110 and the cylinder 120 are coupled to each other. The second sealing member 128 may be arranged at or in a second installation groove of the frame 110.

The plurality of sealing members 127, 128, 129*a*, and 129*b* may include a third sealing member 129*a* provided between the cylinder 120 and the frame 110. The third sealing member 129*a* may be arranged at or in a cylinder groove formed on a rear side of the cylinder 120. The third sealing member 129*a* may prevent the refrigerant in a gas pocket formed between an inner circumferential surface of the frame 110 and an outer circumferential surface of the cylinder 120 from leaking to the outside, thereby increasing a coupling force between the frame 110 and the cylinder 120.

The plurality of sealing members 127, 128, 129*a*, and 129*b* may include a fourth sealing member 129*b* provided at a portion where the frame 110 and the inner stator 148 are coupled to each other. The fourth sealing member 129*b* may be arranged at or in a third installation groove of the frame 110. The first to fourth sealing members 127, 128, 129*a*, and 129*b* may have a ring shape.

The linear compressor 10 may include the first support device 165 coupled to the discharge cover 160 to support one side of the body of the compressor 10. The first support device 165 may be arranged to be adjacent to the second shell cover 103 to elastically support the body of the compressor 10. The first support device 165 may include the first support spring 166. The first support spring 166 may be coupled to the spring fastened parts 101*a* which have been described with reference to FIG. 2.

The linear compressor 10 may include the second support device 185 coupled to the rear cover 170 to support the other side of the body of the linear compressor 10. The second support device 185 may be coupled to the first shell cover 102 to elastically support the body of the compressor 10. The second support device 185 may include a second support spring 186. The second support spring 186 may be coupled to the cover support 102*a*.

The cylinder 120 may include a cylinder body 121 extending in the axial direction and a cylinder flange 122 provided on or at an outer side of a first or front side of the cylinder body 121. The cylinder body 121 may have a cylindrical shape having an axial central axis and may be inserted into the frame 110. Thus, an outer circumferential surface of the cylinder body 121 may be located to face an inner circumferential surface of the frame 110.

A gas inlet 126 into which at least a portion of the refrigerant discharged through the discharge valve 161 may be introduced may be formed in the cylinder body 121. The at least a portion of the refrigerant may be a refrigerant used as a gas bearing between the piston 130 and the cylinder 120. As shown in FIG. 4, the refrigerant used as a gas bearing may flow to the gas pocket formed between the inner circumferential surface of the frame 110 and the outer circumferential surface of the cylinder 120 via a gas hole 114 formed in the frame 110. The refrigerant in the gas pocket may flow to the gas inlet 126.

The gas inlet 126 may be depressed radially inward from the outer circumferential surface of the cylinder body 121. The gas inlet 126 may have a circular shape along an outer circumferential surface of the cylinder body 121 with respect to an axial central axis. A plurality of gas inlets 126 may be provided. For example, there may be two gas inlets 126, but embodiments are not limited thereto.

The cylinder body 121 may include a cylinder nozzle 125 that extends radially inward from the gas inlet 126. The cylinder nozzle 125 may extend to the inner circumferential surface of the cylinder body 121. The refrigerant having passed through the gas inlet 126 may be introduced into a space between the inner circumferential surface of the cylinder body 121 and the outer circumferential surface of the piston body 131 through the cylinder nozzle 125. Such a refrigerant may provide a lifting force to the piston 130 to function as a gas bearing for the piston 130.

Figure 5:
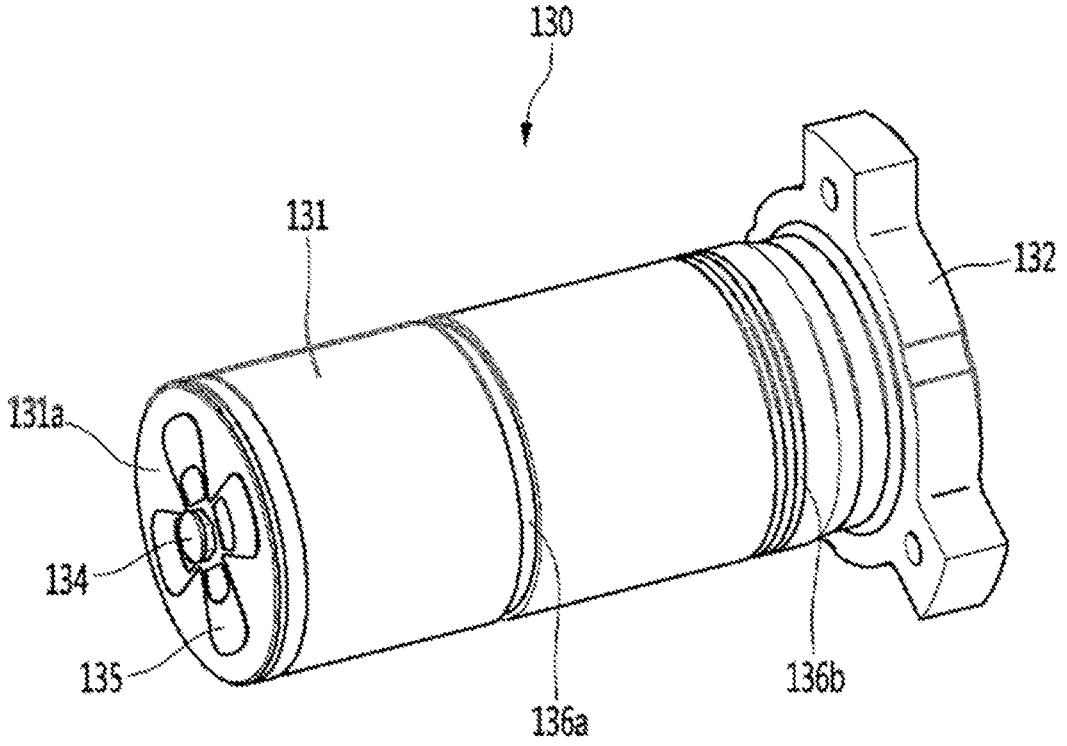
FIG. 5 is a perspective view of a piston according to an embodiment.
Figure 6:
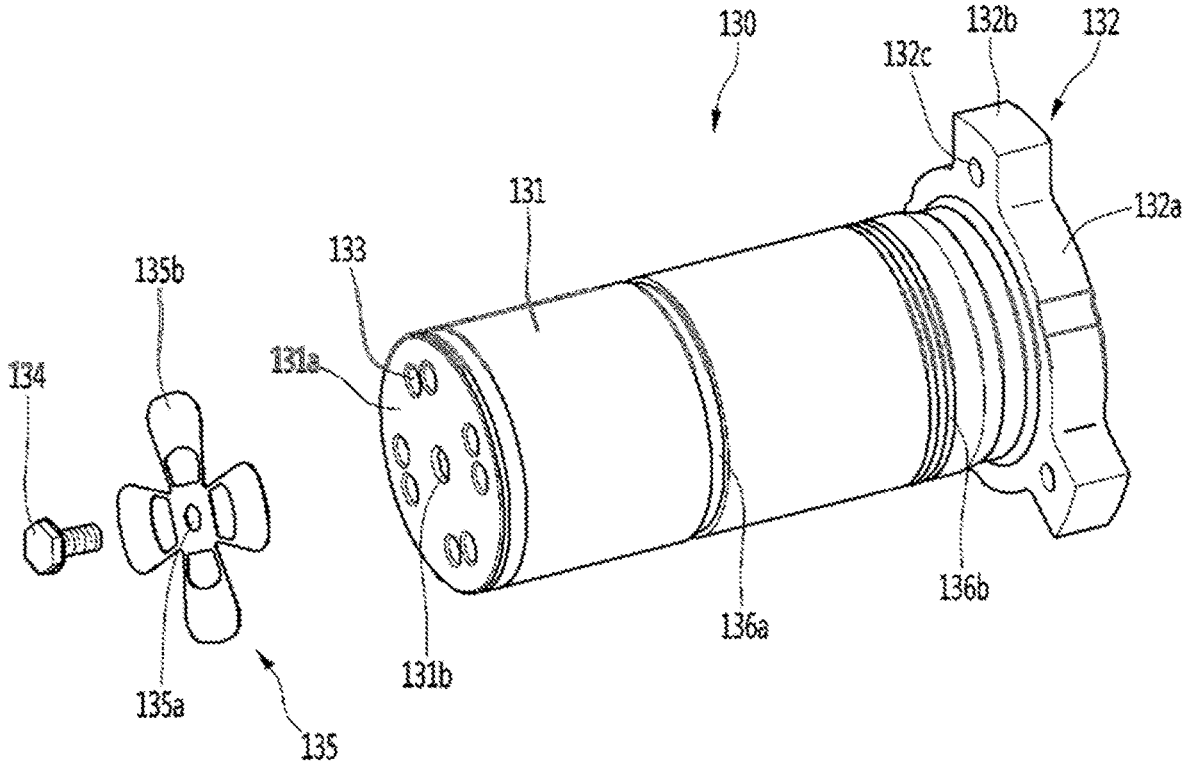
FIG. 6 is an exploded perspective view of the piston of FIG. 5.

Referring to FIG. 5 and FIG. 6, the piston 130 may be provided to reciprocate inside the cylinder 120 in the axial direction, that is, in the first or frontward-rearward direction. The piston 130 may include the piston body 131, which may have a cylindrical shape and may extend in the first or frontward-rearward, and the piston flange 132, which may extend radially outward from the piston body 131.

A body tip 131*a*, in which a fastening hole 131*b* may be formed, may be provided on a first or front side of the piston body 131. The suction hole 133 may be formed in the body tip 131*a*. A plurality of suction holes 133 may be formed on an outer side of the fastening hole 131*b*. The plurality of suction holes 133 may be arranged to surround the fastening hole 131*b*.

For example, the plurality of suction holes 133 may include eight suction holes. As shown in FIG. 6, two suction holes 133 may constitute one pair, and eight suction holes 133 may be arranged on four sides with respect to the fastening hole 131*b*. A number, positions, and shapes of the plurality of suction holes 133 may vary.

The suction valve 135 may be arranged at a front end of the suction holes 133. The suction valve 135 may include a coupling hole 135*a* formed at a center thereof, and a plurality of wings 135*b* formed on an outer side of the coupling hole 135*a*.

The suction valve 135 may be coupled to the fastening hole 131*b* through the predetermined fastener 134. The fastener 134 may be coupled to the piston body 131 by passing through the coupling hole 135*a*. Thus, the fastener 134 may be coupled to the fastening hole 131*b* of the piston 130 by passing through the coupling hole 135*a* of the suction valve 135.

The plurality of wings 135*b* may be provided around the coupling hole 135*a*. For example, the plurality of wings 135*b* may be arranged at positions corresponding to the suction holes 133. Each suction hole 133 may be selectively opened and closed by one wing 135*b*. For example, the plurality of wings 135*b* may include four wings, and each of the four wings 135*b* may open and close the pair of suction holes 133.

A first piston groove 136*a* may be formed on an outer circumferential surface of the piston body 131. The first piston groove 136*a* may be located on or at the front side with respect to a radial center line of the piston body 131. The first piston groove 136*a* may be configured to smoothly guide flow of refrigerant gas introduced through the cylinder nozzle 125 and to prevent loss of pressure.

A second piston groove 136*b* may be formed on the outer circumferential surface of the piston body 131. The second piston groove 136*b* may be located on or at a rear side with respect to the radial center line of the piston body 131. That is, the second piston groove 136*b* may be arranged between the first piston groove 136*a* and the piston flange 132. The second piston groove 136*b* may be a discharge guide groove configured to guide the refrigerant gas used to lift the piston 130 such that the refrigerant gas may be discharged to the outside of the cylinder 120. As the refrigerant gas is discharged to the outside of the cylinder 120 through the second piston groove 136*b*, the refrigerant gas used in the gas bearing may be prevented from being introduced into the compression space P again via the front side of the piston body 131.

The piston flange 132 may include a flange body 132*a* that extends radially outward from a rear side of the piston body 131, and a plurality of piston extensions 132*b* may further extend radially outward from the flange body 132*a*. Each of the piston extensions 132*b* may include a piston fastening hole 132*c* to which a fastener may be coupled. The fastener may be coupled to the magnet frame 138 and the supporter 137 by passing through the piston fastening hole 132*c*. The plurality of piston extensions 132*b* may be arranged on an outer circumferential surface of the flange body 132*a* to be spaced apart from each other.

The rear side of the piston body 131 may be open so that the refrigerant may be suctioned. At least a portion of the suction muffler 150 may be inserted into the piston body 131 through the open rear side of the piston body 131. As described above, the suction muffler 150 may include the first muffler 200, the second muffler 152, and the third muffler 153. The first muffler 200 may be inserted into the piston body 131.

Figure 7:
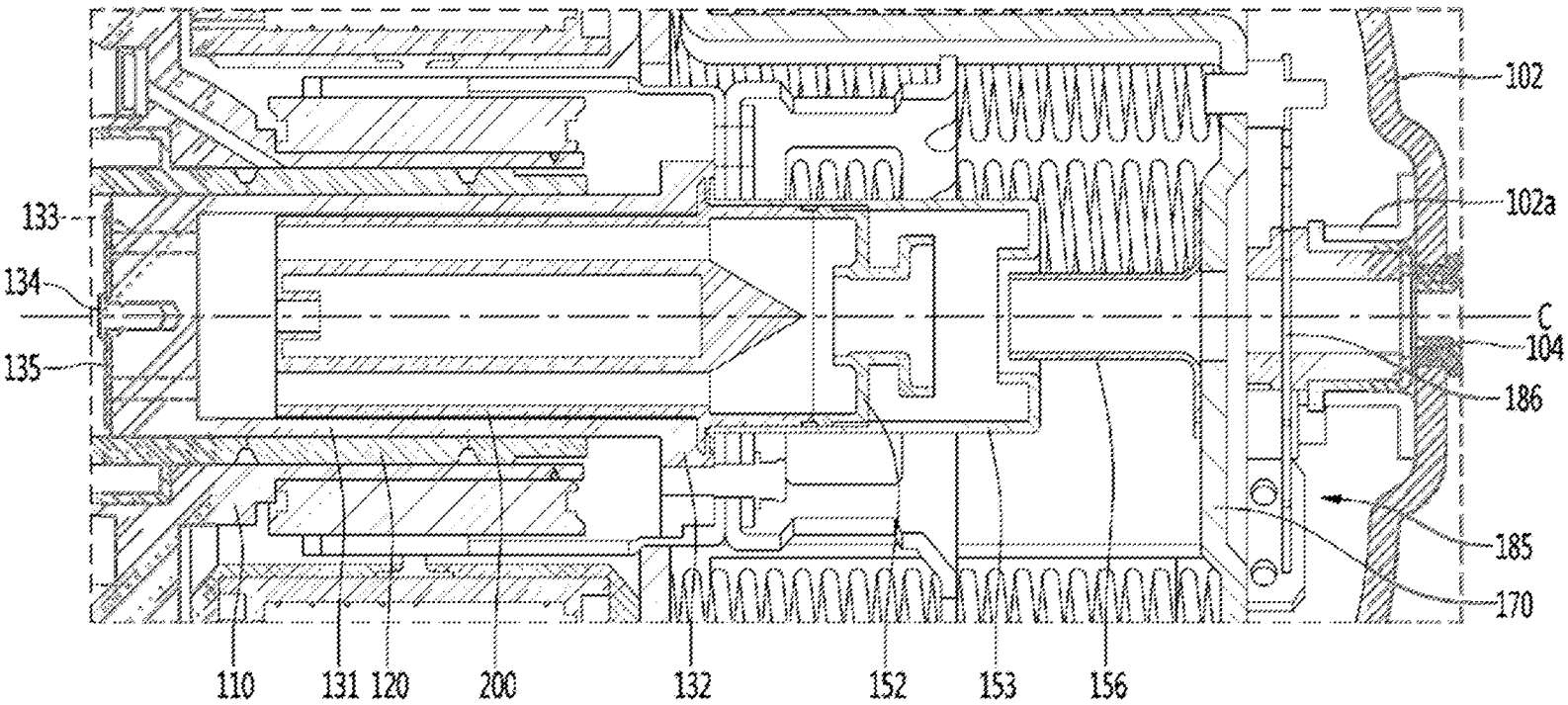
FIG. 7 is an enlarged view of area A of FIG. 4.

Referring to FIG. 7, a center line C and the suction holes 133 of the linear compressor 10 may be is shown as dotted lines. As described above, the refrigerant may be introduced into the shell 101 through the suction pipe 104, and may pass through the suction muffler 150 and the piston 130 to be discharged to the outside of the shell 101.

As shown in FIG. 7, the suction pipe 104 may be located in or at the center line C, and each of the plurality of suction holes 133 of the piston 130 may be eccentric from the center line C. This is because the plurality of suction holes 133 may be arranged on an outer side of the fastening hole 131*b* located in or at the center line C, as shown in FIG. 6.

The refrigerant may pass through the suction pipe 104 and the suction holes 133, which may not be located in a straight line. To minimize loss of flow of the refrigerant, the first muffler 200 may distribute the refrigerant to allow the distributed refrigerant to flow to the suction holes 133.

Figure 8:
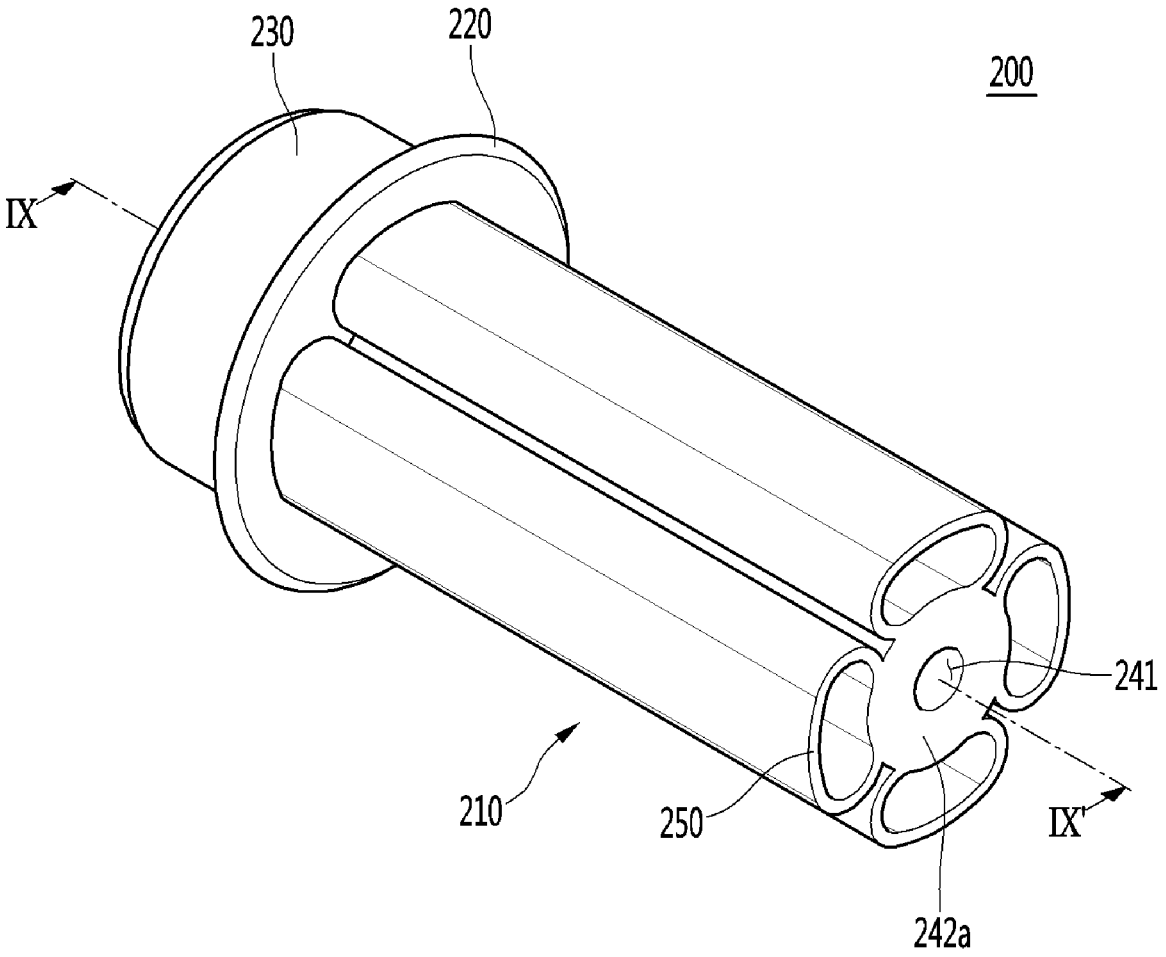
FIG. 8 is a perspective view of a muffler according to an embodiment.
Figure 9:
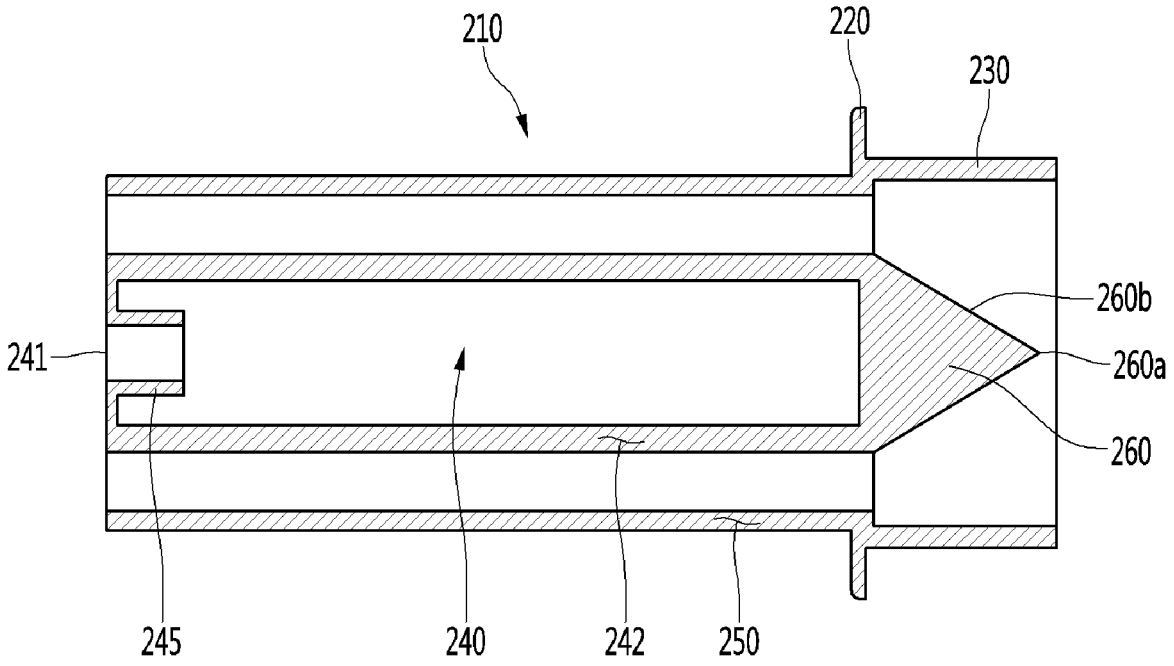
FIG. 9 is a sectional view of the muffler taken along line IX-IX' of FIG. 8.
Figure 10:
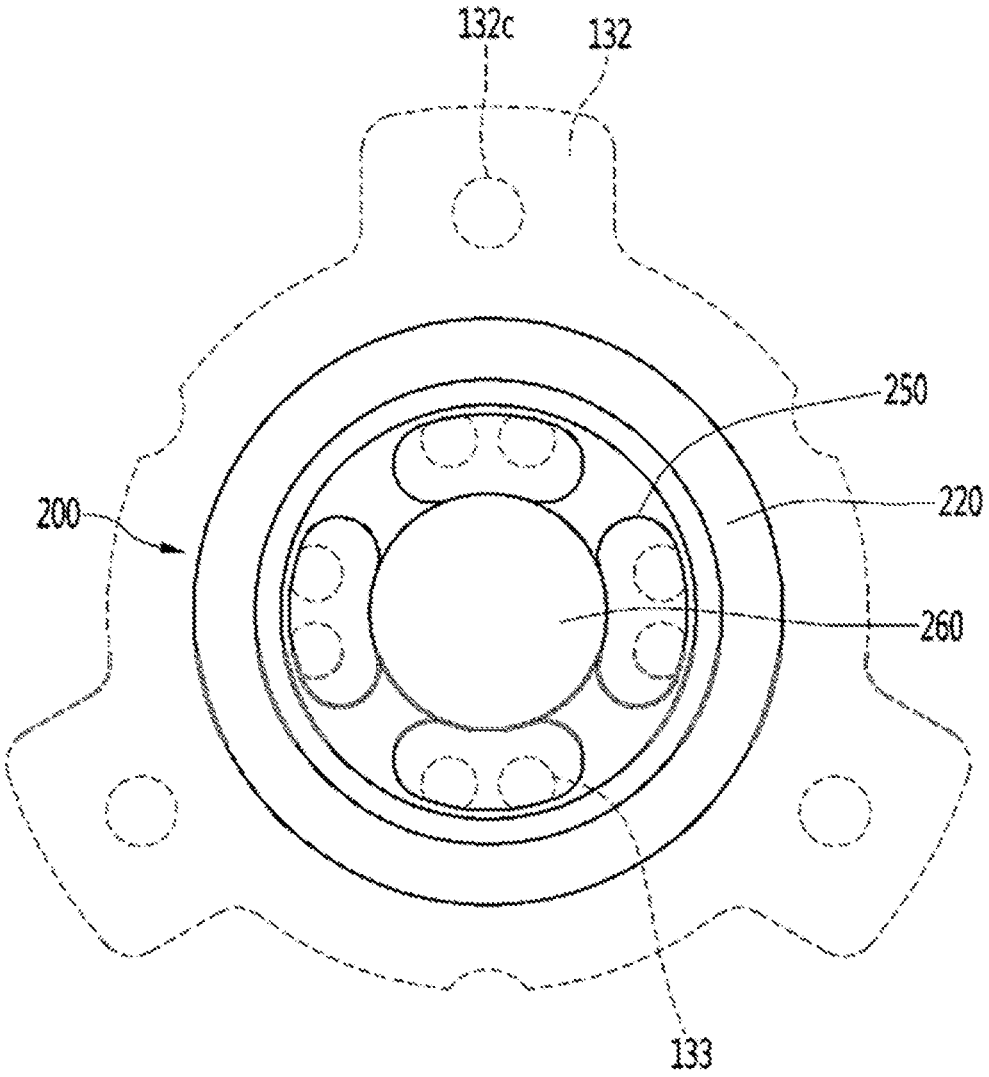
FIG. 10 is a rear view of the muffler of FIG. 8.

Referring to FIG. 8 to FIG. 10, the first muffler 200 may include a seat 220 seated on the piston flange 132, a connector 230 connected to the second muffler 152, and a protrusion 210 arranged inside the piston 130. The seat 220 may radially extend such that one or a first side of the seat 220 may be seated on the piston flange 132, and the magnet frame 138 may be arranged on another or a second side of the seat 220. Thus, the seat 220 may be between the piston flange 132 and the magnet frame 138, and the piston flange 132 and the magnet frame 138 may be coupled to each other through, for example, a fastener so that the first muffler 200 may be fixed.

The connector 230 may extend rearward from the seat 220, and may be connected to the second muffler 152. The third muffler 153 may be coupled to a second or rear side of the first muffler 200 to surround the connector 230 and the second muffler 152.

The protrusion 210 may extend forward from the seat 220 and may be arranged inside the piston 130. The protrusion 210 may include a plurality of flow pipes 250 that extends from the seat 220 to the inside of the piston 130 to guide the refrigerant to the plurality of suction holes 133 of the piston 130, and a resonator 240 arranged on one side of the plurality of flow pipes 250 and having a resonance space therein. For example, the plurality of flow pipes 250 may be arranged on an outer side of the resonator 240 around the resonator 240. As shown in FIG. 8, the plurality of flow pipes 250 may be arranged along a circumference of the resonator 240.

At least one suction hole of the plurality of suction holes 133 may be located to correspond to the plurality of flow pipes 250. The number of the plurality of suction holes 133 may be smaller than a number of the plurality of flow pipes 250. For example, the plurality of flow pipes 250 may include four flow pipes 250. The four flow pipes 250 may be arranged on four sides with respect to a resonance pipe 242. This arrangement may coincide with an arrangement of the plurality of suction holes 133. That is, the plurality of flow pipes 250 may be arranged to correspond to the plurality of suction holes 133. A number, positions, and shapes of the plurality of flow pipes 250 may vary.

In FIG. 10, eight suction holes 133 are represented by dotted lines. As described above, two suction holes 133 may constitute one pair, and four pairs of the plurality of suction holes 133 may be arranged on four sides. The plurality of flow pipes 250 may be arranged such that one flow pipe 250 may correspond to s pair of suction holes 133.

As shown in FIG. 9, the plurality of flow pipes 250 may be in contact with an inner circumferential surface of the piston 130. Accordingly, a distance between the first muffler 200 and the piston 130 may be minimized so that an amount of the refrigerant remaining therebetween may be minimized.

A refrigerant distribution structure or refrigerant distributor 260 may be provided on a second or rear side of an inside of the protrusion 210, that is, inside the connector 230. The refrigerant distributor 260 may distribute the refrigerant flowing along the connector 230 to the plurality of flow pipes 250.

As shown in FIG. 9, the refrigerant distributor 260 may be provided in a form of a cone having a distribution point 260*a* as a vertex. Inclined surfaces 260*b* may be provided toward a first or front end with respect to a distribution point 260*a*, and the refrigerant may be divided at the distribution point 260*a* to flow along the inclined surfaces 260*b*. The flowing refrigerant may be introduced into ends of the plurality of flow pipes 250, may flow to the first or front side of the first muffler 200 along the plurality of flow pipes 250, and may be introduced into the piston 130.

The refrigerant distributor 260 may be located at a center of the first muffler 200. For example, the refrigerant distributor 260 may be arranged at one end of the resonator 240, which may be adjacent to the seat 220. The refrigerant may effectively flow to the plurality of suction holes 133 through the plurality of flow pipes 250 and the refrigerant distributor 260. The refrigerant may be naturally distributed to the plurality of flow pipes 250 along the refrigerant distributor 260, so that a vortex may be prevented.

The resonator 240 may include a resonance pipe 242 having a resonance inlet 241 on one side thereof, and a resonance inlet pipe 245 that extends from the resonance inlet 241 to the inside of the resonance pipe 242, that is, toward a resonance space.

As shown in FIG. 9, the resonance pipe 242 may share an inner wall with the plurality of flow pipes 250 and may be formed on or at an inner side or inner wall of the plurality of flow pipes 250. The resonance pipe 242 and the plurality of flow pipes 250 may be formed to have separate outer walls.

As shown in FIG. 8, the protrusion 210 may include an end 242*a* facing one surface of the piston 130, on which the plurality of suction holes 133 may be formed. The resonance inlet 241 and ends of the plurality of flow pipes 250, through which the refrigerant may be discharged to the piston 130, may be provided at the end 242*a*. That is, the resonance inlet 241 and ends of the plurality of flow pipes 250 may be provided at the end 242*a*, and ends of the plurality of flow pipes 250 may be arranged on or at an outer side of the resonance inlet 241 around the resonance inlet 241.

As described above, the refrigerant distributor 260 may be provided at one or a first end of the resonance pipe 242, which may be adjacent to the seat 220, and the resonance inlet 241 may be provided at another or a second end of the resonance pipe 242. The refrigerant distributed from the refrigerant distributor 260 may be introduced into the ends of the plurality of flow pipes 250, and the refrigerant may be discharged from other ends of the plurality of flow pipes 250 provided at the end 242*a*.

A length, sectional area, and diameter of the resonance inlet pipe 245 and an inner space of the resonance pipe 242 may be formed differently depending on design. For example, the resonance pipe 242 may be one kind of a Helmholtz resonator, and a resonance frequency f thereof may be determined as follows.

$$f = 5410\sqrt{\frac{A}{V(l+0.8d)}}$$

Thus, the resonance frequency f required for the linear compressor 10 may be provided by changing an internal volume V of the resonance pipe 242, and a length L, a sectional area A, and a diameter d of the resonance inlet pipe 245, which may affect the resonance frequency f.

A central empty space defined by the plurality of flow pipes 250 located on or at an outer side to correspond to the plurality of suction holes 133 may be utilized as the resonance pipe 242. That is, by utilizing this empty space, space may be efficiently used, and at the same time, noise prevention may be increased.

The refrigerant having flowed to an inside of the shell 101 through the suction pipe 104 may flow to the piston 130 through the suction muffler 150. The refrigerant may pass through the third muffler 153, the second muffler 152, and the first muffler 200, and may then be distributed in the first muffler 200 along the refrigerant distributor 260. The distributed refrigerant may flow to the plurality of flow pipes 250, and may be discharged from an end of the first muffler 200, that is, the end 242*a* of the protrusion 210. The discharged refrigerant may be suctioned into the compression space P along the plurality of suction holes 133 of the piston 130, and may be compressed. Noise generated during such a suction and compression process may be damped by using the resonator. Generated noise may be damped while moving to an inner space of the resonance pipe 250 along the resonance inlet pipe 245. The refrigerant compressed in the compression space P may be discharged outside of the shell 101 through the discharge pipe 105.

Embodiments disclosed herein solve the above-described problems, and provide a linear compressor which may reduce generated noise, for example, noise generated by a suction hole or suction port of a piston.

Embodiments disclosed herein also provide a linear compressor which may have a structure in which a vortex may not occur when a refrigerant moves from a muffler located outside a piston to a flow pipe or introduction pipe located inside the piston. Embodiments disclosed herein provide a linear compressor which may have a muffler in which the flow pipe may be divided such that the flow pipe and the suction hole that may be eccentric from a center may be located in a straight line.

In the previous detailed description of embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylinder that defines a compression space;

a piston having a plurality of suction holes through which refrigerant is introduced into the compression space; and a muffler connected to the piston and through which the refrigerant supplied to the piston flows, the muffler including:

a seat seated on one end of the piston; and a protrusion arranged at an inside of the piston, the protrusion including:

a plurality of flow pipes that extends from the seat to the inside of the piston to guide the refrigerant to the plurality of suction holes; and a resonator arranged at radially inside of the plurality of flow pipes and having a resonance space therein.

2. The linear compressor of claim 1, wherein the plurality of flow pipes is arranged outside of the resonator around the resonator.

3. The linear compressor of claim 2, wherein the plurality of flow pipes is arranged along a circumference of the resonator.

4. The linear compressor of claim 2, wherein a refrigerant distributor configured to distribute the refrigerant to the plurality of flow pipes is provided in the muffler.

5. The linear compressor of claim 4, wherein the refrigerant distributor is provided in a form of a cone having a distribution point as a vertex and having inclined surfaces.

6. The linear compressor of claim 4, wherein the refrigerant distributor is arranged at one end of the resonator, which is adjacent to the seat.

7. The linear compressor of claim 2, wherein each of the plurality of flow pipes is substantially aligned with at least one suction hole of the plurality of suction holes.

8. The linear compressor of claim 7, wherein a number of the plurality of suction holes is smaller than a number of the plurality of flow pipes.

9. The linear compressor of claim 1, wherein the resonator includes:

a resonance pipe having a resonance inlet at one side thereof; and a resonance inlet pipe that extends from the resonance inlet to an inside of the resonance pipe.

10. The linear compressor of claim 9, wherein the protrusion includes an end that faces one surface of the piston on which the plurality of suction holes is formed, wherein the resonance inlet and ends of the plurality of flow pipes, through which the refrigerant is discharged to the piston, are provided at the end of the protrusion.

11. The linear compressor of claim 1, wherein the plurality of flow pipes is in contact with an inner circumferential surface of the piston.

12. A linear compressor, comprising:

a shell that defines an outer appearance;

a suction pipe provided on one end of the shell through which a refrigerant is suctioned to an inside of the shell; and a suction muffler provided to reduce noise generated by the refrigerant suctioned through the suction pipe, wherein the suction muffler includes:

a first muffler having a resonance space therein;

a second muffler coupled to one side of the first muffler; and a third muffler that accommodates the second muffler therein, and extends to a rear side of the first muffler, wherein the first muffler includes a refrigerant distributor located at a center of the first muffler and arranged at one end of the resonance space.

13. The linear compressor of claim 12 wherein the refrigerant suctioned into the inside of the shell through the suction pipe sequentially passes through the third muffler, the second muffler, and the first muffler.

14. The linear compressor of claim 12, further comprising a piston arranged inside the shell, wherein at least a portion of the first muffler is located inside the piston.

15. The linear compressor of claim 14, wherein the first muffler includes:

a protrusion arranged inside the piston;

a connector connected to the second muffler; and a seat provided between the protrusion and the connector and seated on the piston.

16. The linear compressor of claim 15, wherein the protrusion includes a plurality of flow pipes provided to guide the refrigerant to the piston, and a resonator having the resonance space arranged between the plurality of flow pipes.

17. The linear compressor of claim 16, wherein the plurality of flow pipes is arranged along a circumference of the resonator.

18. A linear compressor, comprising:

a suction pipe into which refrigerant is introduced; and a muffler through which refrigerant introduced through the suction pipe passes, wherein the muffler includes:

a plurality of flow pipes;

a refrigerant distributor configured to distribute the refrigerant such that the refrigerant flows to the plurality of flow pipes; and a resonator arranged between the plurality of flow pipes to define a predetermined resonance space, wherein the plurality of flow pipes is arranged outside of the resonator around the resonator.

19. The linear compressor of claim 18, further comprising a piston connected to the muffler, wherein refrigerant having flowed through the plurality of flow pipes is suctioned into the piston and is compressed, and wherein noise generated while the refrigerant is suctioned and compressed is damped by the resonator.

20. The linear compressor of claim 18, wherein the refrigerant distributor is provided at one end of the resonator.

* * * * *